US008903273B2

(12) United States Patent
Kamimura et al.

(10) Patent No.: US 8,903,273 B2
(45) Date of Patent: Dec. 2, 2014

(54) IMAGE FORMING DEVICE HAVING RETAINING MEMBER THAT CAN BE PULLED OUT THEREFROM

(75) Inventors: Naoya Kamimura, Ichinomiya (JP); Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 271 days.

(21) Appl. No.: 12/979,980

(22) Filed: Dec. 28, 2010

(65) Prior Publication Data

US 2011/0182613 A1 Jul. 28, 2011

(30) Foreign Application Priority Data

Jan. 22, 2010 (JP) ..... 2010-012054

(51) Int. Cl.

| | |
|---|---|
| ***G03G 15/04*** | (2006.01) |
| ***G03G 15/01*** | (2006.01) |
| ***G03G 15/08*** | (2006.01) |
| ***G03G 21/16*** | (2006.01) |

(52) U.S. Cl.

CPC ..... *G03G 15/0896* (2013.01); *G03G 15/0178* (2013.01); *G03G 2221/1684* (2013.01); *G03G 21/1623* (2013.01)

USPC ..... 399/119

(58) Field of Classification Search

USPC ..... 399/110, 113, 119

See application file for complete search history.

(56) References Cited

U.S. PATENT DOCUMENTS

| | | | | |
|---|---|---|---|---|
| 4,814,821 | A * | 3/1989 | Sawayama et al. | 399/111 |
| 2003/0053819 | A1* | 3/2003 | Nomura et al. | 399/110 |
| 2007/0160384 | A1 | 7/2007 | Sakurai et al. | |
| 2007/0189811 | A1* | 8/2007 | Sato | 399/254 |
| 2008/0199228 | A1* | 8/2008 | Tokimatsu | 399/267 |
| 2008/0213005 | A1 | 9/2008 | Kobayashi | |
| 2009/0087215 | A1 | 4/2009 | Sakuma | |
| 2009/0169252 | A1 | 7/2009 | Sato | |

(Continued)

FOREIGN PATENT DOCUMENTS

| | | | |
|---|---|---|---|
| CN | 101000487 | A | 7/2007 |
| EP | 1816527 | A2 | 8/2007 |

(Continued)

OTHER PUBLICATIONS

Machine translation of Tamaru, JP 2010-032573.*

(Continued)

*Primary Examiner* — David Gray
*Assistant Examiner* — Sevan A Aydin
(74) *Attorney, Agent, or Firm* — Baker Botts L.L.P.

(57) ABSTRACT

An image forming device includes a casing, photosensitive bodies, developing devices, developer accommodating devices, and a retaining member. The developer accommodating devices includes a first developer accommodating device that is individually replaceable and separable from the corresponding developing device and a second developer accommodating device that is replaceable together with the corresponding developing device. The retaining member retains the photosensitive bodies arranged in an arrangement direction, the developing devices, and the developer accommodating devices at fixed positions within the casing. The retaining member is capable of being pulled out from the casing and is movable between a housed position and a withdrawn position. One of the developer accommodating devices located at a most downstream side in the arrangement direction is the first developer accommodating device, and each of the developer accommodating devices other than the one of the developer accommodating devices is the second developer accommodating device.

13 Claims, 9 Drawing Sheets

(56) References Cited

U.S. PATENT DOCUMENTS

| | | | |
|---|---|---|---|
| 2009/0180802 | A1 | 7/2009 | Sato et al. |
| 2009/0196652 | A1 | 8/2009 | Sakuma |
| 2010/0021201 | A1 | 1/2010 | Tamaru |
| 2010/0209139 | A1 | 8/2010 | Sakurai et al. |
| 2011/0182612 | A1 | 7/2011 | Kamimura et al. |

FOREIGN PATENT DOCUMENTS

| | | | |
|---|---|---|---|
| JP | 2003-195727 | A | 7/2003 |
| JP | 2008-032755 | A | 2/2008 |
| JP | 2008-046403 | A | 2/2008 |
| JP | 2009-025844 | A | 2/2009 |
| JP | 2009-048219 | A | 3/2009 |
| JP | 2009-157209 | A | 7/2009 |
| JP | 2009-181077 | A | 8/2009 |
| JP | 2009-186999 | A | 8/2009 |
| JP | 2009-271099 | A | 11/2009 |
| JP | 2010-032573 | A | 2/2010 |
| JP | 2011-150178 | A | 8/2011 |
| WO | 2009/087945 | A1 | 7/2009 |

OTHER PUBLICATIONS

Machine translation of Tamaru, JP 2010-032573 (2010).*

Japan Patent Office, Office Action for Japanese Patent Application No. 2010-012054 (counterpart to above-captioned patent application), mailed Dec. 13, 2011.

European Patent Office, extended European Search Report for European Patent Application No. 10016104.1 (counterpart to above-captioned patent application), dated Jun. 28, 2012.

State Intellectual Property Office of the People's Republic of China, Notification of the First Office Action for Chinese Patent Application No. 201110029938.2 (counterpart to above-captioned patent application), mailed Jun. 4, 2013.

State Intellectual Property Office of the People's Republic of China, The Second Office Action for Chinese Patent Application No. 201110029938.2 (counterpart to above-captioned patent application), mailed Feb. 12, 2014.

* cited by examiner

IMAGE FORMING DEVICE HAVING RETAINING MEMBER THAT CAN BE PULLED OUT THEREFROM

CROSS REFERENCE TO RELATED APPLICATION

This application claims priority from Japanese Patent Application No. 2010-012054 filed Jan. 22, 2010. The entire content of this priority application is incorporated herein by reference.

TECHNICAL FIELD

The present invention relates in general to an image-forming device for forming images on recording sheets, and more particularly to an image-forming device having a plurality of photosensitive members arranged in tandem and retained together with corresponding developing devices and developer-accommodating devices at fixed positions in a retaining member that can be withdrawn from a body of the image-forming device along the juxtaposed direction of the photosensitive members.

BACKGROUND

An image-forming device such as a laser printer for forming color images on recording sheets is well known in the art. One such image-forming device has a plurality of photosensitive members and a plurality of corresponding developer cartridges (each integrally formed of a developing device and a developer-accommodating device) arranged in tandem and held at fixed positions within a retaining member. Parts, consumables, and the like in the photosensitive members and the developer cartridges can be replaced by pulling the retaining member out from a body of the image-forming device along the direction in which the photosensitive members are juxtaposed.

SUMMARY

In order to keep down running costs in a laser printer or other image-forming device, it is beneficial to be able to separate the developer-accommodating devices (toner cartridges) from the developing devices and the photosensitive members so that the developer-accommodating devices can be replaced individually. However, when developing devices having such individually detachable toner cartridges are employed in an image-forming device configured with a retaining member that is pulled out of the image-forming device in the direction of the juxtaposed photosensitive members, the force applied to the extracted retaining member as a result of operations performed to open and close shutters in the toner cartridge when mounting and removing the toner cartridge can potentially damage the retaining member or cause the image-forming device to overturn.

It is an object of the present invention to provide an image-forming device having photosensitive members arranged in tandem in a retaining member that can be pulled out of a body of the image-forming device along the juxtaposing direction of this tandem arrangement, whereby one of the developing devices provided in the retaining member has an individually detachable toner cartridge for reducing running costs and the configuration eliminates the risk of damaging the retaining member and overturning the body of the image-forming device due to forces applied to the retaining member when the retaining member is partially withdrawn from the body.

In order to attain the above and other objects, the present invention provides an image forming device. The image forming device includes a casing, a plurality of photosensitive bodies, a plurality of developing devices, a plurality of developer accommodating devices, and a retaining member. The casing is formed with a first opening. The plurality of developing devices respectively corresponds to the plurality of photosensitive bodies. The plurality of developer accommodating devices accommodates and supplies developer respectively to the plurality of developing devices. The plurality of developer accommodating devices includes a first developer accommodating device that is individually replaceable and separable from the corresponding developing device and a second developer accommodating device that is replaceable integrally together with the corresponding developing device. The retaining member retains the plurality of photosensitive bodies arranged in an arrangement direction, the plurality of developing devices, and the plurality of developer accommodating devices at fixed positions within the casing. The retaining member is capable of being pulled out from the casing in the arrangement direction through the first opening and is movable between a first position where the plurality of photosensitive bodies, the plurality of developing devices, and the plurality of developer accommodating devices are inside the casing and a second position where one of the plurality of developer accommodating devices located at a most upstream side in the arrangement direction is replaceable. Another one of the plurality of developer accommodating devices located at a most downstream side in the arrangement direction is the first developer accommodating device accommodating black developer, and each of the developer accommodating devices other than the another one of the plurality of developer accommodating devices is the second developer accommodating device.

BRIEF DESCRIPTION OF THE DRAWINGS

The particular features and advantages of the invention as well as other objects will become apparent from the following description taken in connection with the accompanying drawings, in which.

DETAILED DESCRIPTION

Next, preferred embodiments of the present invention will be described while referring to the accompanying drawings. The following description first covers the overall structure of a color multifunction device of a first embodiment according to the present invention and subsequently includes a detailed description of a process unit having a developer-accommodating device accommodating black developer.

Figure 1:
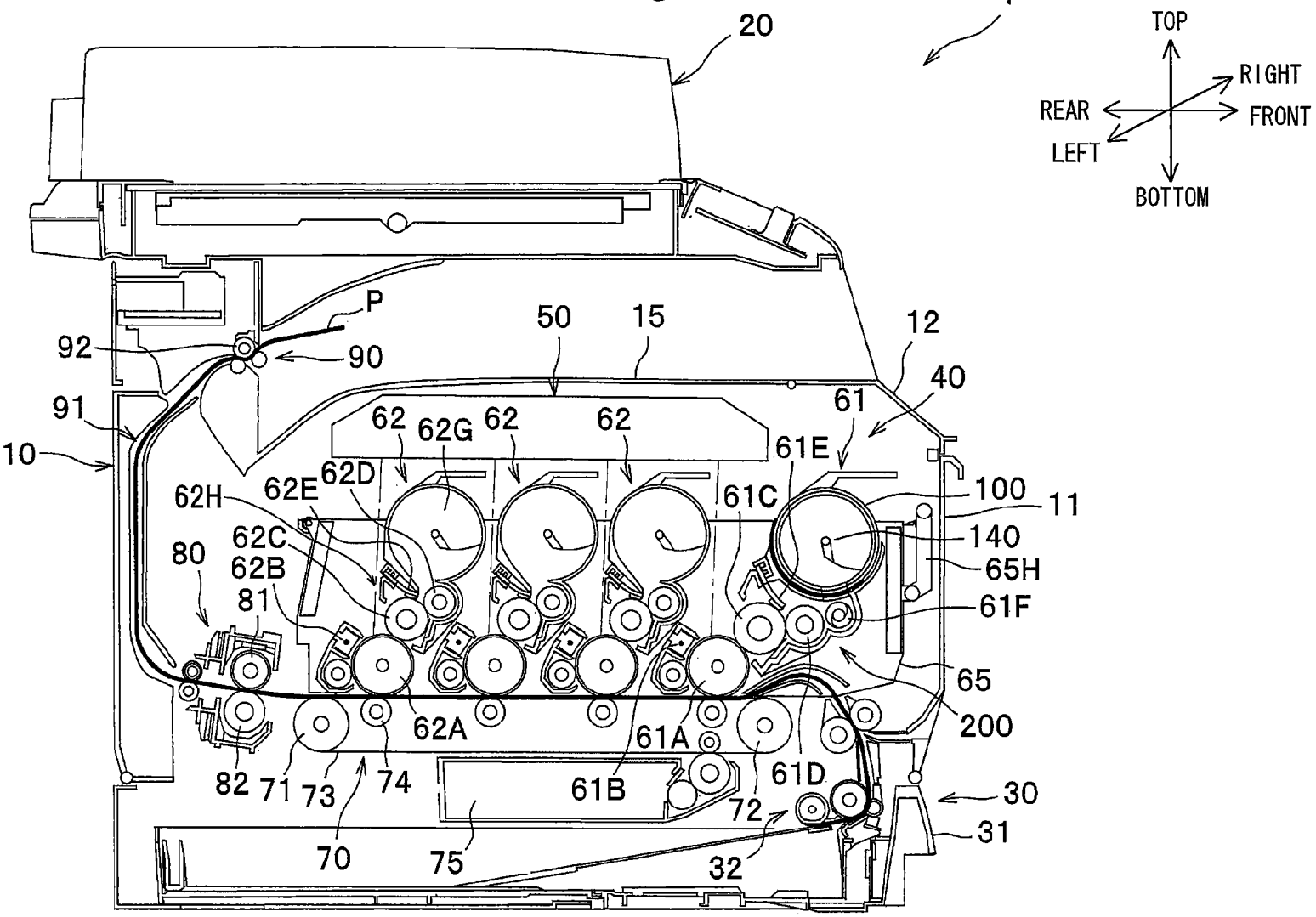
FIG. 1 is a cross-sectional view showing a color multifunction device according to a first embodiment of the present invention.

As shown in FIG. 1, a color multifunction device 1 has a main body 10 and a flatbed scanner 20 disposed above the main body 10. Within the main body 10, the color multifunction device 1 primarily includes a sheet-feeding unit 30 for supplying sheets of a paper P, an image-forming unit 40 for forming images on sheets of paper P supplied by the sheet-feeding unit 30, and a sheet-discharging unit 90 for discharging the sheets of paper P after images have been formed thereon.

In the following description, directions related to the color multifunction device 1 will refer to directions seen from the perspective of an operator when operating the color multifunction device 1. Specifically, the right side of the color multifunction device 1 in FIG. 1 will be referred to as the "front" or the "near side"; the left side as the "rear" or the "far side"; the near side in FIG. 1 as "left"; and the far side in FIG. 1 as "right." Also, the upper and lower sides along the vertical in FIG. 1 will be referred to as "upper" and "lower" in the description.

The flatbed scanner 20 disposed above the main body 10 is a document-reading device well known in the art. During a copy operation and the like, the flatbed scanner 20 generates image data by irradiating light onto an original document placed in the flatbed scanner 20 and reads the image from the original document.

The sheet-feeding unit 30 is disposed in a bottom section of the main body 10 and includes a paper tray 31 for accommodating sheets of paper P, and a paper-feeding mechanism 32 for conveying sheets of paper P from the paper tray 31 to the image-forming unit 40. The paper-feeding mechanism 32 separates and conveys the paper P accommodated in the paper tray 31 to the image-forming unit 40 one sheet at a time.

The image-forming unit 40 primarily includes an exposure unit 50, four process units including a process unit 61 and three process units 62, a transfer unit 70, and a fixing unit 80.

The exposure unit 50 is provided in a top section of the main body 10 and includes a laser light source, a polygon mirror, lenses, reflecting mirrors, and the like (not shown in the drawings). Laser beams emitted from the laser light source are reflected off the polygon mirror and the reflecting mirrors, pass through the lenses, and are scanned at a high speed over surfaces of photosensitive drums described later.

The process unit 61 and the process units 62 are disposed between the sheet-feeding unit 30 and the exposure unit 50 and are juxtaposed (arranged in tandem) in the front-to-rear direction. The process units 61 and 62 are held in a retaining case 65.

Figure 4:
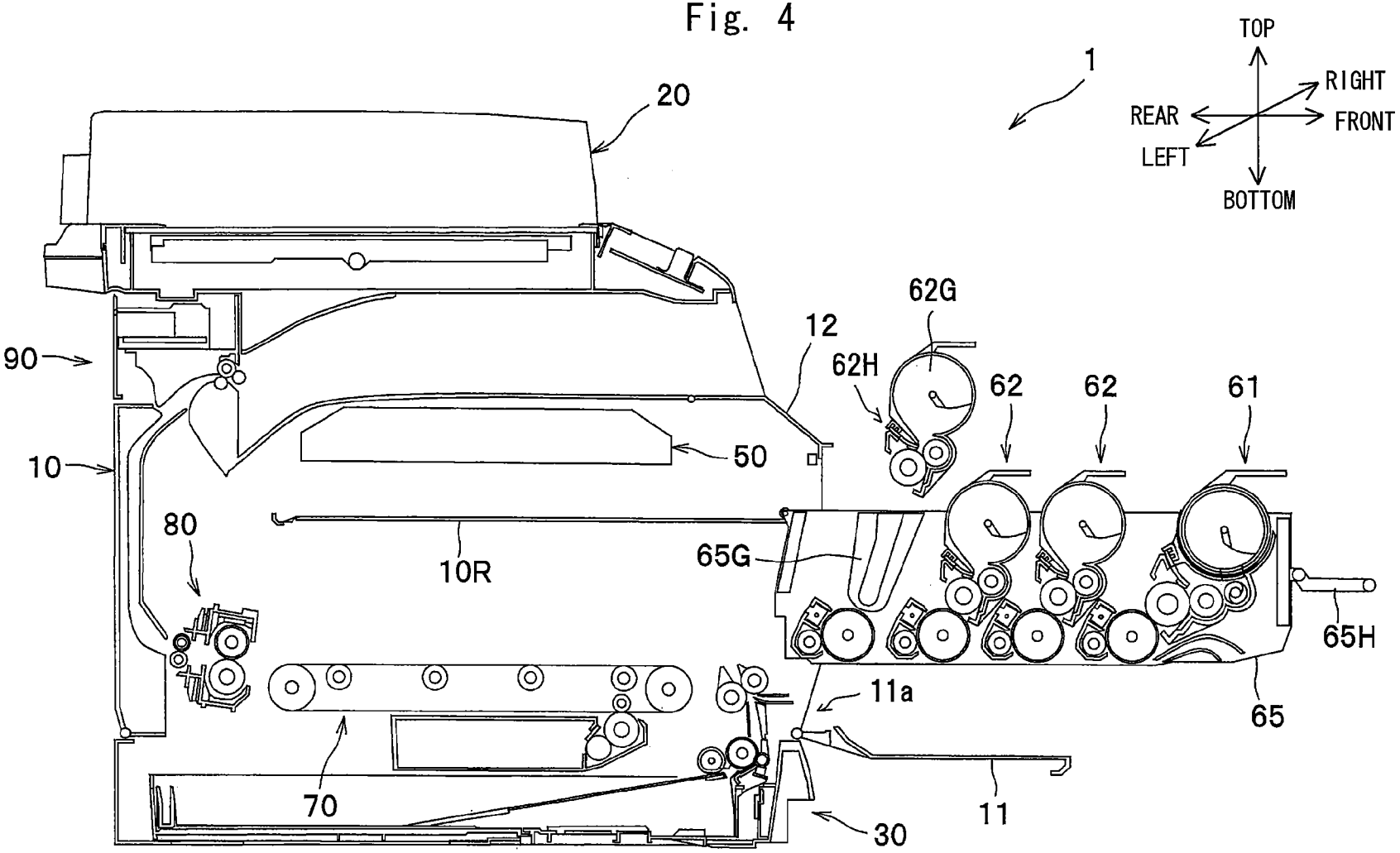
FIG. 4 is a cross-sectional view illustrating an operation in which a developing device and a developer accommodating device disposed on a farthest side of a retaining member are replaced.

The retaining case 65 has a bottomless frame-like structure, for example, and is capable of moving between a first position where the retaining case 65 is mounted in the main body 10 (see FIG. 1) and a second position where the retaining case 65 is removed forwardly from the main body 10 (see FIG. 4). Guide rails 10R (see FIG. 4) are formed on inner sides of the main body 10 for guiding the retaining case 65 in the front-to-rear direction. A front cover 11 is provided on a front side of the main body 10 over a first opening 11*a* formed in the main body 10 and can be pivotally rotated downward to expose the first opening 11*a* or upward to cover the first opening 11*a*. A handle 65H is provided on a front end of the retaining case 65. By opening the front cover 11 and pulling on the handle 65H, an operator can pull the retaining case 65 out of the main body 10 in a pull-out direction, i.e., moves the retaining case 65 to the second position, as illustrated in FIG. 4. Once the retaining case 65 has been positioned at the second position, the operator can replace components of the process units 62 that, during their normal operating state, are positioned far side (rearward) of the main body 10. That is, the second position indicates the position of the retaining case 65 at which the process unit 61 disposed nearest side of the retaining case 65 among the four process units 61 and 62 with respect to the pull-out direction can be accessed and replaced.

Figure 2:
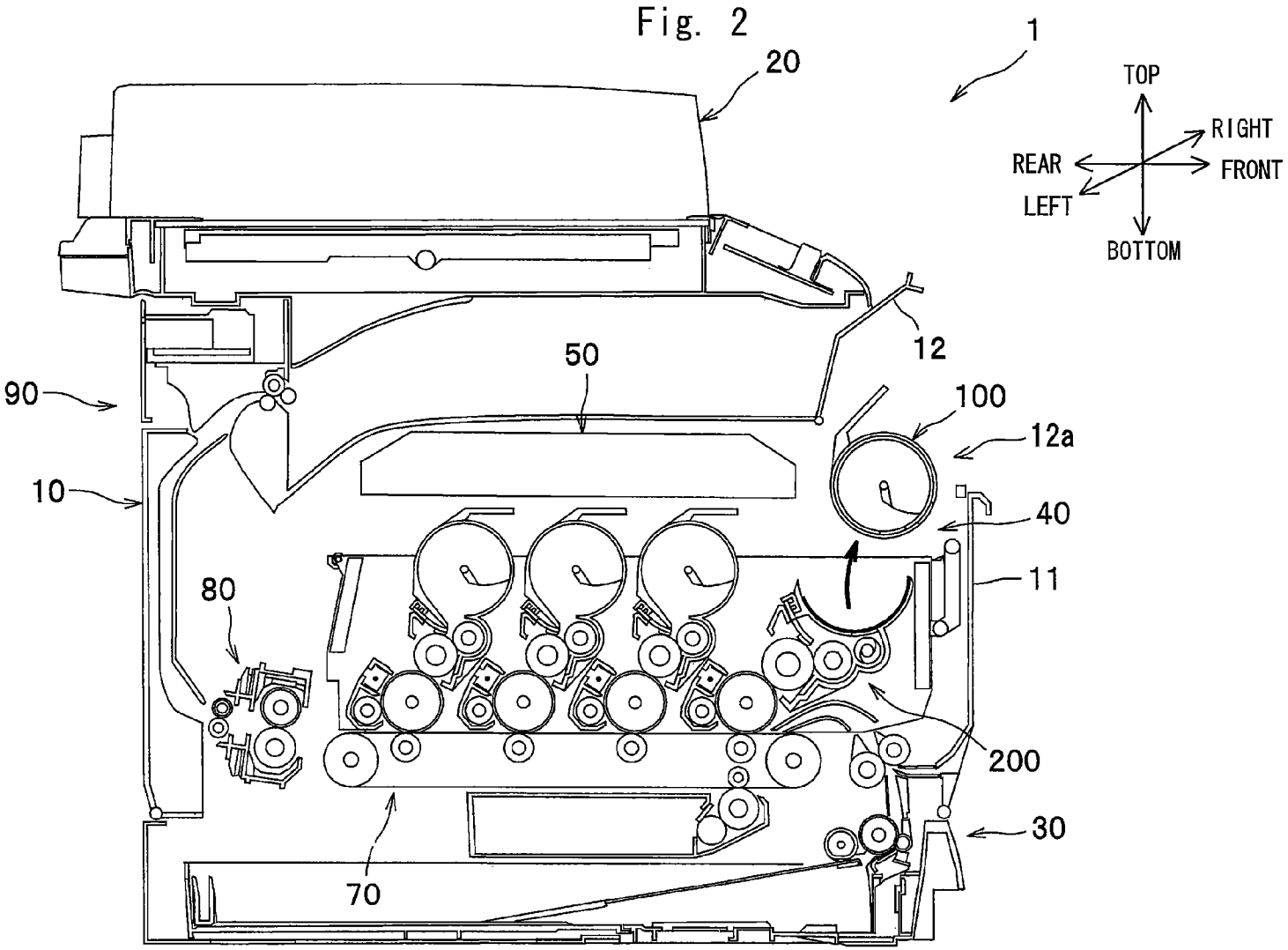
FIG. 2 is a cross-sectional view illustrating an operation in which a black toner cartridge is removed from a developing device.
Figure 3:
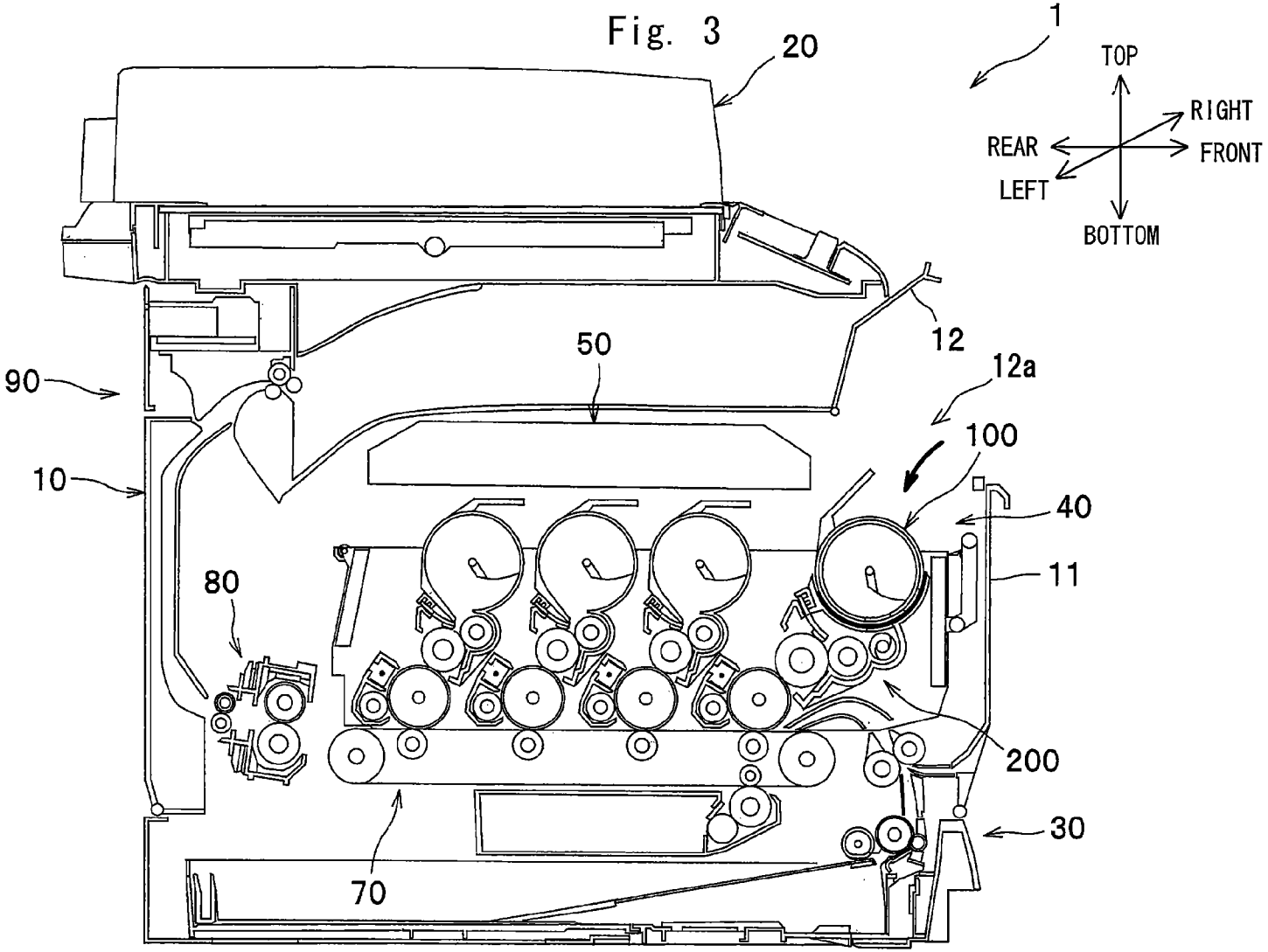
FIG. 3 is a cross-sectional view illustrating an operation in which the black toner cartridge is attached to the developing device.

An upper cover 12 can open and close a second opening 12*a* formed at a position immediately above the first opening 11*a* and penetrating the main body 10 in top-to-bottom direction. The upper cover 12 is provided on an upper front portion of the main body 10 (immediately above the front cover 11). As shown in FIGS. 2 and 3, the process unit 61 disposed on the nearest side of the retaining case 65 can be accessed through the second opening 12*a* by opening the upper cover 12, without pulling the retaining case 65 out of the main body 10, enabling the operator to mount or replace a toner cartridge 100 (described later in greater detail) in the process unit 61.

As shown in FIG. 1, the process unit 61 disposed on the nearest side of the retaining case 65 among the four process units includes a photosensitive drum 61A, a charger 61B, the toner cartridge 100 accommodating black toner, and a developing device 200. The developing device 200 includes a developing roller 61C, a supply roller 61D, a thickness-regulating blade 61E, and an auger 61F. Specifically, the supply roller 61D is disposed closer to the near side than the developing roller 61C and the auger 61F is disposed closer to the near side than the supply roller 61D as shown in FIG. 1. The toner cartridge 100 is disposed above the auger 61F. The structure of the process unit 61 will be described later in greater detail.

The photosensitive drum 61A and the charger 61B of the process unit 61 may be configured so that they are mounted in and removed from the retaining case 65 together (i.e., replaceable as a unit) or may be fixed to the retaining case 65 to form a single unit therewith. Alternatively, the developing roller 61C, the supply roller 61D, the thickness-regulating blade 61E, and the auger 61F constituting the developing device 200 may be configured as an integrated unit that is mounted in and removed from the retaining case 65, or may be fixed to the retaining case 65 together with the photosensitive drum 61A and the charger 61B and formed as a single unit with the retaining case 65. If the developing device 200 is detachably mounted in the retaining case 65, the photosensitive drum 61A and the charger 61B may be configured to be detachably mounted as a unit or to be mounted and removed separately.

Each of the three process units 62 among the four process units disposed farther rearward in the retaining case 65 includes a photosensitive drum 62A, a charger 62B, a developing roller 62C, a supply roller 62D, a thickness-regulating blade 62E, and a developer-accommodating device 62G. The developer-accommodating devices 62G of these process units 62 accommodate toner in one of the colors cyan, magenta, and yellow, respectively. A developing device 62H of each process unit 62 is configured of the developing roller 62C, the supply roller 62D, and the thickness-regulating blade 62E and is integrally configured with the developer-accommodating device 62G and detachably mounted in the retaining case 65 (see FIG. 4).

As with the photosensitive drum 61A and the charger 61B of the process unit 61, the photosensitive drum 62A and the charger 62B of the process unit 62 may be configured to be detachably mounted in the retaining case 65 (i.e., replaceable) or fixed to the retaining case 65 to form a single unit therewith. The process unit 62 (i.e., the photosensitive drum 62A, the charger 62B, the developing roller 62C, the supply roller 62D, the thickness-regulating blade 62E, and the developer-accommodating device 62G) may be detachably mounted in the retaining case 65 as a unit.

The transfer unit 70 is disposed between the sheet-feeding unit 30 and the process units 61 and 62. The transfer unit 70 primarily includes a drive roller 71, a follow roller 72, an endless conveying belt 73 stretched taut about the rollers 71 and 72, and four transfer rollers 74. The outer surface of the conveying belt 73 is in contact with each of the photosensitive drums 61A and 62A and is pinched between the transfer rollers 74 disposed on the inner side of the conveying belt 73 and the photosensitive drums 61A and 62A.

A cleaning unit 75 is disposed beneath the conveying belt 73. The cleaning unit 75 contacts the conveying belt 73 for removing toner, paper dust, and other deposited matter from the conveying belt 73 and for recovering this deposited matter.

The fixing unit 80 is disposed rearward of the process units 61 and 62 and the transfer unit 70. The fixing unit 80 primarily includes a heating roller 81, and a pressure roller 82 disposed in confrontation with the heating roller 81 and applying pressure to the same.

In the image-forming unit 40, the chargers 61B and 62B apply a uniform charge to the respective surfaces of the photosensitive drums 61A and 62A, after which the surfaces are exposed to laser beams emitted from the exposure unit 50 in a high-speed scan to form electrostatic latent images on the charged surfaces of the photosensitive drums 61A and 62A based on image data. Toner accommodated in the toner cartridge 100 and the developer-accommodating devices 62G is supplied respectively to the developing rollers 61C and 62C via the supply rollers 61D and 62D. As the developing rollers 61C and 62C rotate, toner carried on the surfaces of the same is regulated to a prescribed thickness by the respective thickness-regulating blades 61E and 62E.

The toner layers of uniform thickness carried on the developing rollers 61C and 62C are supplied to the electrostatic latent images formed on the photosensitive drums 61A and 62A, respectively, whereby the electrostatic latent images are developed into visible toner images on the photosensitive drums 61A and 62A. Subsequently, as a sheet of paper P carried on the conveying belt 73 is sequentially conveyed between the photosensitive drums 61A and 62A and the conveying belt 73 (the transfer rollers 74), the toner images carried on the photosensitive drums 61A and 62A are sequentially transferred onto and superposed on the sheet of paper P. When the sheet of paper P is then conveyed between the heating roller 81 and the pressure roller 82, the toner images transferred on the sheet are fixed to the sheet by heat.

The sheet-discharging unit 90 primarily includes a paper-discharge path 91 for guiding sheets of paper P upward in the main body 10 from the exit side of the fixing unit 80 while inverting the sheets, and a discharge roller 92 for discharging the inverted sheets onto a discharge tray 15 formed on top of the main body 10. Thus, after the toner images are fixed to a sheet of paper P by heat in the fixing unit 80, the sheet is conveyed from the fixing unit 80 into the paper-discharge path 91, and the discharge roller 92 discharges the sheet onto the discharge tray 15.

Figure 5:
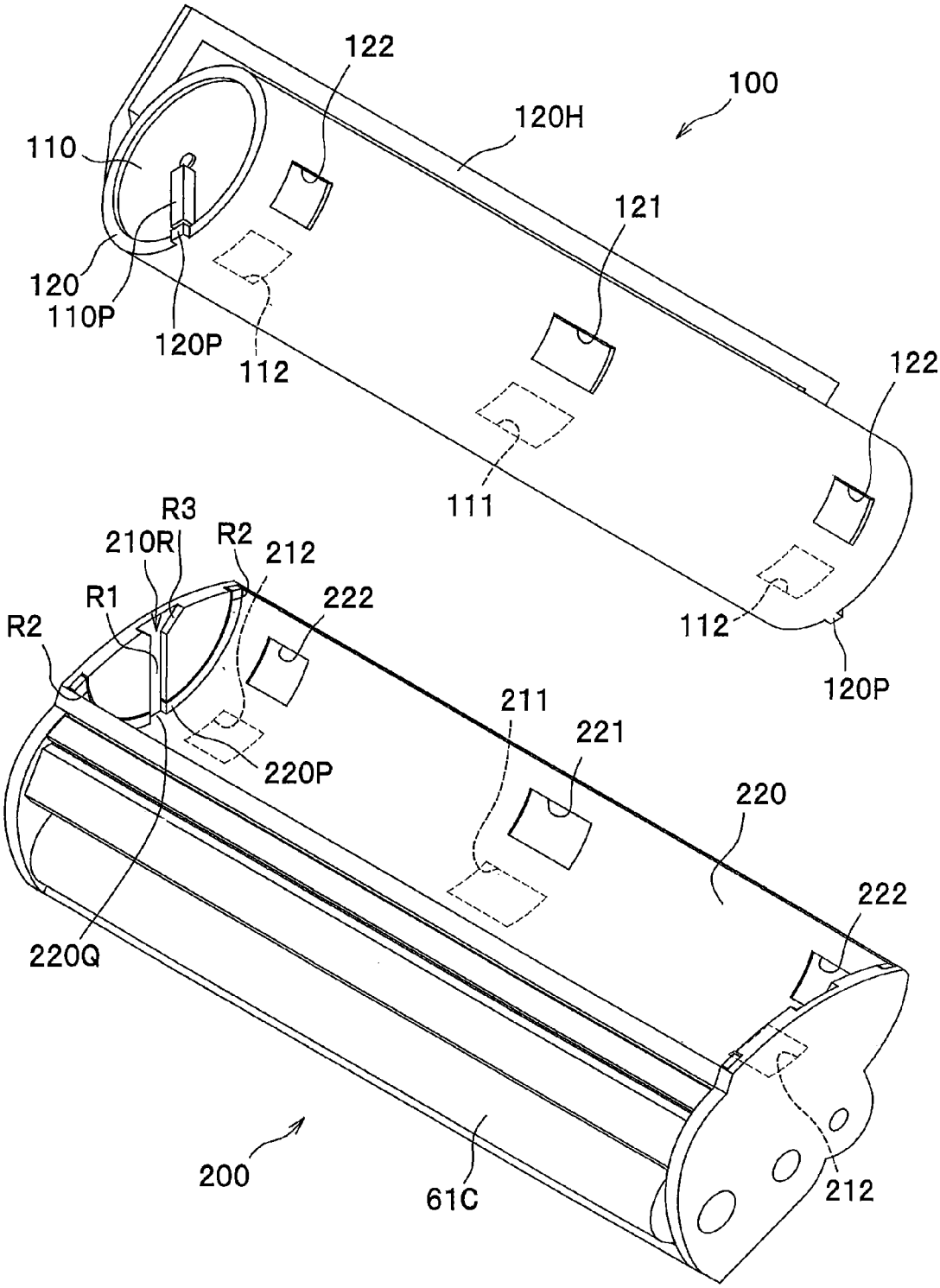
FIG. 5 is a perspective view showing the toner cartridge and the developing device when shutters are at a closed position.
Figure 6:
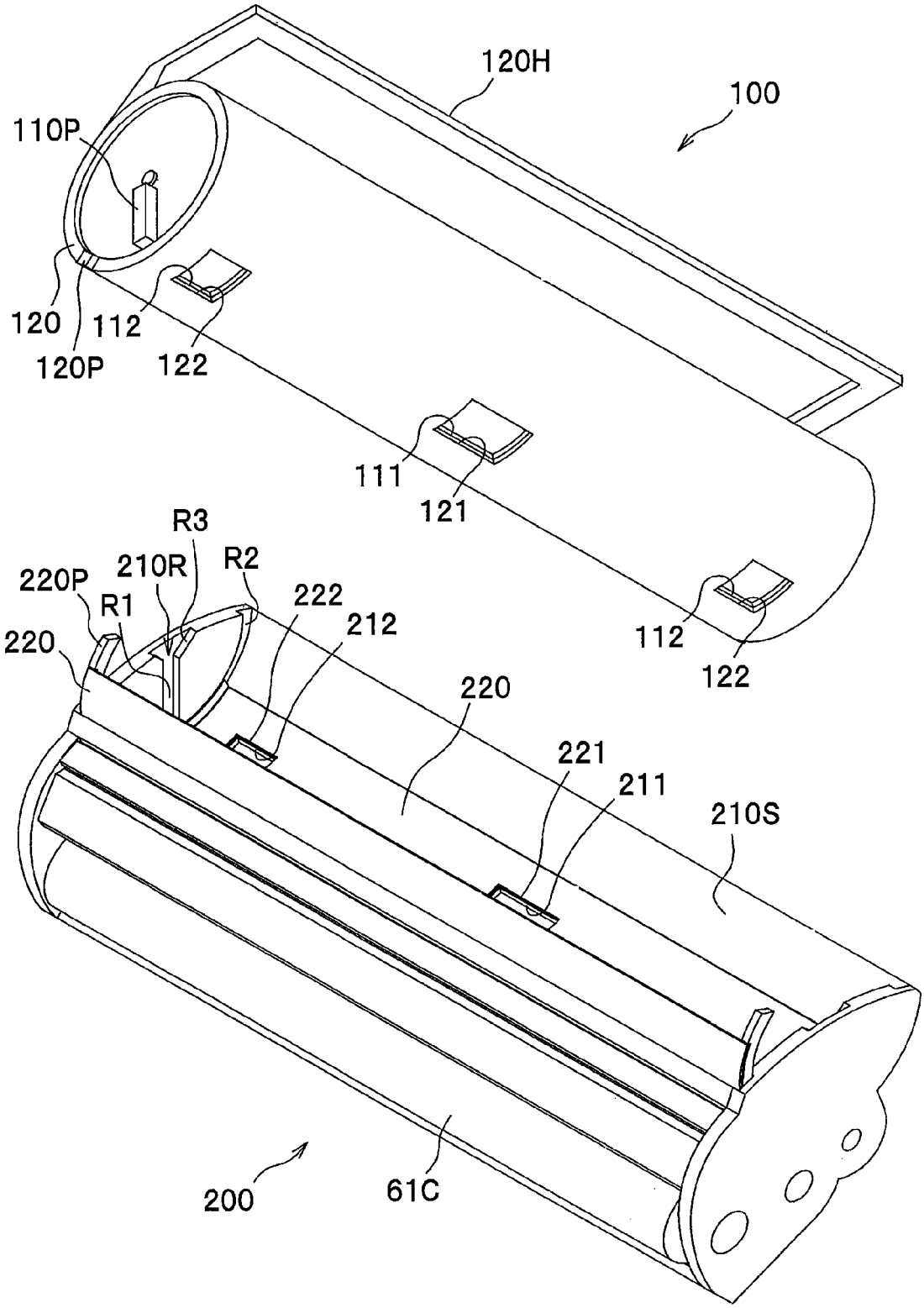
FIG. 6 is a perspective view showing the toner cartridge and the developing device when the shutters are at an open position.

Next, the structure of the process unit 61 (the toner cartridge 100 and the developing device 200) will be described in detail and contrasted with the process units 62 while referring primarily to FIGS. 5 and 6. FIGS. 5 and 6 show a bottom view of the toner cartridge 100 and a top view of the developing device 200.

As shown in FIGS. 2 and 3, the toner cartridge 100 of the process unit 61 is detachably mounted on the developing device 200. When mounted on the developing device 200, the toner cartridge 100 is positioned above and adjacent to the developing device 200.

As shown in FIGS. 5 and 6, the toner cartridge 100 is a substantially cylindrical container with side walls 110 closing both left and right ends thereof. The cylindrically shaped wall of the toner cartridge 100 are formed with a first supply opening 111 for supplying toner from the toner cartridge 100 to the developing device 200, and first return openings 112 for returning toner from the developing device 200 to the toner cartridge 100 (see FIG. 7).

A cylindrical first shutter 120 is provided on the toner cartridge 100 around the cylindrical wall of the toner cartridge 100. By rotating the first shutter 120 in a circumferential direction relative to the toner cartridge 100, the shutter 120 can open and close the first supply opening 111 and the first return openings 112. Specifically, a first shutter supply opening 121 and the first shutter return openings 122 are formed in the first shutter 120 at positions that perfectly overlap the respective first supply opening 111 and the first return openings 112 formed in the toner cartridge 100 when the first shutter 120 is in an open position illustrated in FIG. 6. When the first shutter 120 is rotated a prescribed stroke in the circumferential direction relative to the toner cartridge 100 to a closed position illustrated in FIG. 5, the first shutter 120 completely blocks the first supply opening 111 and the first return openings 112.

A ridge part 110P is provided on each of the left and right side walls 110 of the toner cartridge 100. The ridge parts 110P extend radially from the center of the side walls 110 to the outer edge thereof and have a rectangular cross section. Protruding parts 120P having the same cross-sectional shape as the ridge parts 110P are provided on longitudinal ends of the first shutter 120.

When the first shutter 120 is set in the closed position as shown in FIG. 5, the protruding parts 120P are aligned with the outer ends of the corresponding ridge parts 110P, forming continuous guide rails for guiding the toner cartridge 100 when the toner cartridge 100 is mounted on the developing device 200 described later. When the first shutter 120 is rotated to the open position while the toner cartridge 100 is attached to the developing device 200, the protruding parts 120P move circumferentially within second groove parts R2 (described later in greater detail) formed in side walls of the developing device 200 so that the toner cartridge 100 is engaged (interlocked) with the developing device 200 (see FIG. 6).

A handle 120H is provided on the peripheral surface of the first shutter 120. The handle 120H extends horizontally rearward from an upper portion of the first shutter 120 when the toner cartridge 100 is mounted on the developing device 200 (i.e., when the first shutter 120 is in the open position), as shown in FIG. 1. When the operator grips the handle 120H and rotates the handle 120H from this horizontal position upward relative to the mounted toner cartridge 100, the first shutter 120 is rotated to the closed position, disengaging (unlocking) the toner cartridge 100 from the developing device 200 so that the toner cartridge 100 can be removed (see FIG. 2).

Figure 7:
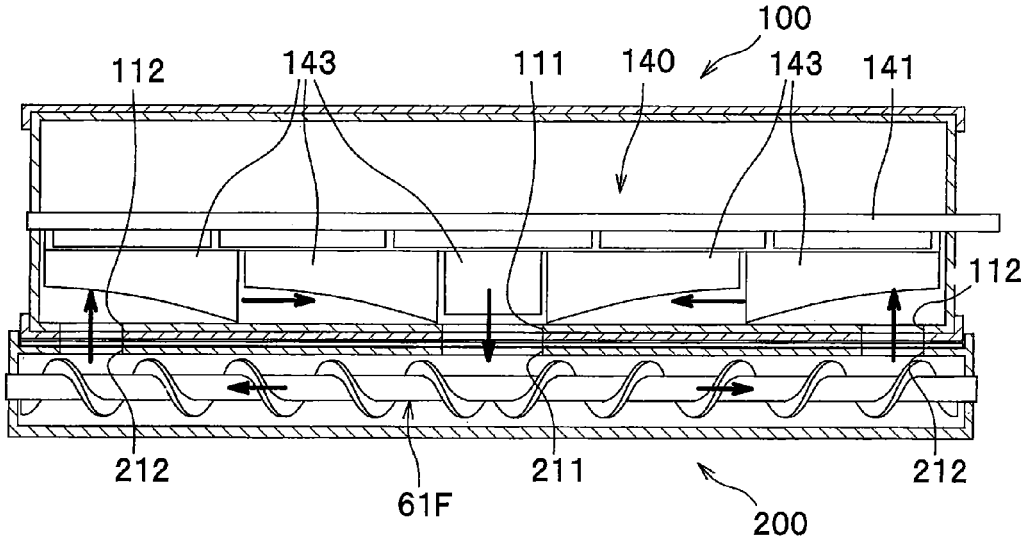
FIG. 7 is an explanatory diagram illustrating a circulation of toner in a process unit.

Further, an agitator 140 well known in the art is provided inside the toner cartridge 100 (see FIG. 1). As shown in FIG. 7, the agitator 140 is primarily configured of a rotational shaft 141 rotatably supported in the left and right side walls 110, and a plurality of sheet-like agitating blades 143. The agitating blades 143 are formed of a flexible material and are fixed to the rotational shaft 141. The agitating blades 143 are formed such that their dimension along the radial direction away from the rotational shaft 141 varies along the axial direction of the rotational shaft 141. Specifically, the radial length of the agitating blades 143 is longer toward the center region of the rotational shaft 141 at which the first supply opening 111 is located than toward the ends at which the first return openings 112 are located. However, the agitating blade 143 positioned opposite the first supply opening 111 is formed with a uniform radial length.

A motor (not shown) provided in the main body 10 applies a drive force to the rotational shaft 141 for rotating the agitator 140 in the toner cartridge 100. When the rotational shaft 141 rotates, the distal edges of the agitating blades 143 slanted relative to the rotational shaft 141 scrape against the inner surface of the toner cartridge 100, agitating toner in the toner cartridge 100 and conveying this toner from the left and right ends at which the first return openings 112 are formed toward the center region at which the first supply opening 111 is formed as indicated by arrows in FIG. 7.

As shown in FIG. 7, the auger 61F is configured to convey toner supplied through the central first supply opening 111 (and a second supplying opening 211 described later) toward the left and right first return openings 112 (and second return openings 212 described later). The auger 61F may be configured of a screw-type auger, as in the example shown in FIG. 7, which is primarily configured of a rotational shaft rotatably supported in the left and right walls of the developing device 200, and helical bits wound in a spiral shape around this rotational shaft. As shown in FIG. 6, an accommodating recessed part 210S is formed at a position adjacent to the auger 61F for accommodating the toner cartridge 100.

As shown in FIGS. 5 and 6, the second supplying opening 211 and the second return openings 212 are formed in a curved wall of the developing device 200 forming the arch shape (arc-shaped in a cross section) of the accommodating recessed part 210S at positions respectively corresponding to the first supply opening 111 and first return openings 112 formed in the toner cartridge 100 (see also FIG. 7). The second supplying opening 211 functions to supply toner from the toner cartridge 100 to the developing device 200, while the second return openings 212 function to return toner from the developing device 200 to the toner cartridge 100.

Hence, when toner is supplied into the developing device 200 through the first supply opening 111 of the toner cartridge 100 and the second supplying opening 211, the auger 61F conveys this toner from the center region of the developing device 200 (conveying start region) toward the left and right longitudinal end regions (conveying end regions), as indicated by arrows in FIG. 7. Through this conveying process, residual toner in the developing device 200 that the supply roller 61D did not supply to the developing roller 61C is circulated back through the second return openings 212 and the first return openings 112 formed on both ends of the toner cartridge 100 and recovered in the toner cartridge 100.

A second shutter 220 is also provided in the developing device 200 around the arch-shaped wall of the accommodating recessed part 210S. By rotating in a circumferential direction relative to the accommodating recessed part 210S, the second shutter 220 can open and close the second supplying opening 211 and second return openings 212 formed in the accommodating recessed part 210S. More specifically, a second shutter supply opening 221 and second shutter return openings 222 are formed in the second shutter 220 at positions that are perfectly aligned with the second supplying opening 211 and the second return openings 212 formed in the developing device 200 when the second shutter 220 is in an open position (see FIG. 6). By rotating the second shutter 220 a prescribed stroke in the circumferential direction relative to the developing device 200 to a closed position, the second shutter 220 completely blocks the second supplying opening 211 and the second return openings 212 (see FIG. 5).

A grooved part 210R is formed on the inside surface of each of the left and right walls of the accommodating recessed part 210S. The grooved part 210R includes a first groove part R1 extending radially downward from the center of curvature of the accommodating recessed part 210S, a second groove part R2 following circumferential directions (both forward and rearward) from the bottom end of the first groove part R1, and a funnel-shaped part R3 formed at the top of the first groove part R1 in a funnel shape that widens toward the top in order to facilitate insertion of the ridge part 110P and the protruding part 120P when mounting the toner cartridge 100 in the accommodating recessed part 210S.

An inner circumferential protruding part 220P is formed on each of the left and right ends of the second shutter 220 for slidably engaging in the second groove parts R2. A notched part 220Q is formed in the inner circumferential protruding part 220P in the portion opposing the bottom end of the first groove part R1 when the second shutter 220 is at the closed position so that the protruding part 120P can be inserted into the notched part 220Q when mounting the toner cartridge 100 (see FIG. 5).

Figure 8:
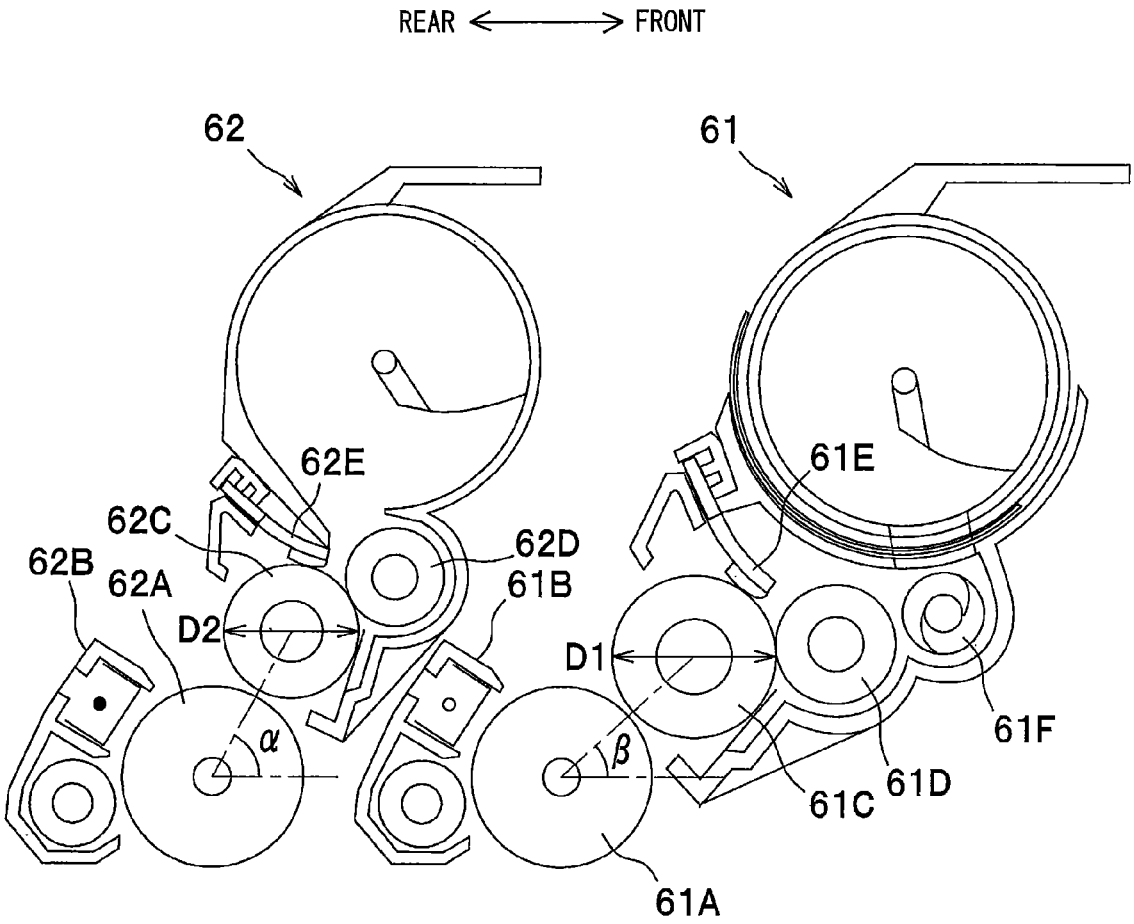
FIG. 8 is a cross-sectional view illustrating a feature of a developing roller provided in the developing device corresponding to the black toner cartridge.

The process unit 61 in the first embodiment is arranged with the supply roller 61D forward of the developing roller 61C and the auger 61F forward of the supply roller 61D. Further, in a comparison between the process unit 61 and the process unit 62 as illustrated in FIG. 8, an angle $\beta$ formed by a plane passing through the rotational shaft of the developing roller 61C and the rotational shaft of the photosensitive drum 61A and a horizontal plane passing through the rotational shaft of the photosensitive drum 61A is smaller than a similar angle $\alpha$ formed in the process unit 62 ($\alpha>\beta$). Thus, the position of the developing roller 61C has been shifted farther forward in relation to the photosensitive drum 61A than the position of the developing roller 62C in relation to the photosensitive drum 62A.

By arranging the components of the developing device 200 in this way, the toner cartridge 100 mounted above the auger 61F is farther forward and separated from the position of the photosensitive drum 61A with respect to the front-to-rear direction. As a result, the toner cartridge 100 can be disposed in a position that in a plan view is not overlapped by the exposure unit 50 used to expose the photosensitive drum 61A from above (see FIG. 1).

Hence, unlike the process units 62 positioned farther back in the retaining case 65, the process unit 61 positioned nearest forward can be accessed from above without interference from the exposure unit 50, even when the retaining case 65 is fully accommodated in the main body 10 (i.e., when the retaining case 65 is at the first position), in order to mount or replace the toner cartridge 100. Further, since the toner cartridge 100 can be accessed by opening the upper cover 12, the operator can mount or remove the toner cartridge 100 through the second opening 12*a* while appropriately opening the shutters 120 and 220 simply by gripping and operating the handle 120H, and need not open the front cover 11.

Further, the developing roller 61C of the process unit 61 is configured of a larger roller than the developing roller 62C of the process unit 62. Specifically, the developing roller 61C has a diameter D1 that is greater than a diameter D2 of the developing roller 62C (D1>D2). Hence, the supply roller 61D and the auger 61F are shifted farther forward in their layout arrangement, enabling the toner cartridge 100 to be disposed in a position that facilitates mounting and removal operations from above.

Generally, the developing roller 61C is provided with sealing members that is disposed at both width ends surface thereof in order to prevent toner from leaking from the developing roller 61C. Since the surface of the developing roller 61C has a smaller curvature due to the larger diameter, it is possible to use a sealing member that has a simple structural design and is suitable for long-term use.

Consequently, the developing device 200 of the process unit 61, which can be mounted and removed separately from the toner cartridge 100, may be configured to have a longer lifespan than the developing device 62H of the process unit 62, which has the developer-accommodating device 62G integrally provided with the developing device 62H. Accordingly, the effects of using the toner cartridge 100 in the process unit 61 to reduce running costs can be better exploited.

While chemical toner is used for the color toner accommodated in the developer-accommodating devices 62G of the process units 62 in the first embodiment, pulverized toner is used for the black toner accommodated in the toner cartridge 100 of the process unit 61.

Here, "chemical toner" denotes toner that is manufactured according to chemical processes, in contrast to the traditional toners that are manufactured through a mechanical pulverizing process. Chemical toner can be produced through a variety of methods, including emulsion polymerization and aggregation, suspension polymerization, emulsion aggregation, and dissolution suspension. "Pulverized toner" includes not only traditional toner manufactured according to a mechanical pulverizing process, but also to the same toner that has been chemically treated to produce rounder toner particles.

By employing pulverized toner, which has lower fluidity than chemical toner, it is possible to reduce the likelihood of toner leaking from the developing device 200 and to extend the service life of the developing device 200 in terms of the number of printed sheets, since the service life is greatly dependent on the lifespan of the toner leakage preventing seal.

Next, operations for replacing the toner cartridge 100 in the process unit 61 having the above construction will be described.

When the process unit 61 is positioned as shown in FIG. 1, the toner cartridge 100 is engaged with the developing device 200, and the first shutter 120 and the second shutter 220 are at the open position. In other words, as shown in FIG. 6, the protruding part 120P of the first shutter 120 is at a position offset from the ridge part 110P and is inset in the second groove part R2. Thus, the mounted toner cartridge 100 is firmly and inseparably fixed to the developing device 200.

When the toner cartridge 100 is out of black toner or needs to be replaced for any reason, the operator first opens the upper cover 12 and then rotates the handle 120H rearward (counterclockwise direction in FIG. 1). When the handle 120H is rotated in this way, the first and second shutters 120 and 220 on the toner cartridge 100 and developing device 200 are closed and the toner cartridge 100 is disengaged from the developing device 200. Next, the operator extracts the toner cartridge 100 upward through the second opening 12*a*, i.e., in a direction indicated by the arrow in FIG. 2.

More specifically, the operation to rotate the handle 120H rearward shifts the first shutter 120 and the second shutter 220 from the position shown in FIG. 6 to the position shown in FIG. 5, causing the first shutter 120 and the second shutter 220 to shift to the closed position and the protruding parts 120P of the first shutter 120 to arrive at a position aligned with the ridge parts 110P. Consequently, the protruding parts 120P can pass through the respective first groove parts R1 which are the portion of the grooved parts 210R that extend radially, thereby enabling the operator to pull the toner cartridge 100 upward, as illustrated in FIG. 2.

When mounting a new toner cartridge 100 in the process unit 61, the operator opens the upper cover 12 to expose the second opening 12*a*, as shown in FIG. 3. Next, the operator inserts the toner cartridge 100 through the second opening 12*a*, in the direction indicated by an arrow in FIG. 3, and sets the toner cartridge 100 in the process unit 61.

During this operation, the operator aligns the ridge parts 110P and the protruding parts 120P on left and right sides of the toner cartridge 100 in the state shown in FIG. 5 with the grooved parts 210R on the left and right sides of the developing device 200 and inserts the ridge parts 110P and the protruding parts 120P in the corresponding grooved parts 210R until the entire toner cartridge 100 is seated in the accommodating recessed part 210S of the developing device 200. Subsequently, the operator rotates the handle 120H forward (clockwise direction in FIG. 3), moving the first shutter 120 and the second shutter 220 to their open positions shown in FIG. 6.

Through this operation, the protruding parts 120P of the first shutter 120 enter the respective second groove parts R2 of the grooved parts 210R and move to a position offset from the respective ridge parts 110P. Accordingly, the mounted toner cartridge 100 is firmly fixed to and inseparable from the developing device 200.

Since the second shutter 220 of the developing device 200 opens and closes the second supplying opening 211 and the second return openings 212 in association with the handle 120H opening and closing the first shutter 120, both the first shutter 120 and the second shutter 220 are easily opened and closed through a single operation. Further, the toner cartridge 100 is disengaged from the developing device 200 in association with the operation of the handle 120H to switch these shutters 120 and 220 to their closed positions and is engaged with the developing device 200 in association with the operation of the handle 120H to switch the shutters 120 and 220 to their open positions, thereby achieving both safety and simplicity of operations.

When one of the developer-accommodating devices 62G of the process units 62 must be replaced together with the developing device 62H (i.e., the developing roller 62C, the supply roller 62D, and the thickness-regulating blade 62E) because the developer-accommodating device 62G has run out of cyan, magenta, or yellow toner, for example, the operator opens the front cover 11, grips the handle 65H, and pulls the retaining case 65 forward to move the second position and replace the relevant components, as illustrated in FIG. 4. Here, the retaining case 65 may be completely separately removed from the main body 10 before replacing the components of the process units 62.

As shown in FIG. 4, guide grooves 65G are formed in the inner surfaces of both side walls constituting the retaining case 65. The guide grooves 65G function to guide the vertical sliding movement of the developer-accommodating devices 62G and the developing devices 62H when they are mounted in the retaining case 65 and to maintain the mounted developing devices 62H (particularly the developing rollers 62C) at a fixed position in the bottom ends of the guide grooves 65G. This construction for mounting and removing the developer-accommodating devices 62G and the developing device 62H facilitates the smooth replacement of components in the process units 62.

The color multifunction device 1 according to the first embodiment having the construction described above primarily produces the following advantages and effects.

In the color multifunction device 1 of the first embodiment, the process unit 61 is mounted in the retaining case 65 at a position closest to the near side relative to the pull-out direction of the retaining case 65. Further, the toner cartridge 100 accommodating black toner is detachably provided in the process unit 61. Accordingly, the toner cartridge 100 accommodating black toner can be replaced easily and safely without pulling the retaining case 65 outward while reducing running costs for the color multifunction device 1, thereby eliminating the risk of damaging the retaining case 65 and overrunning the main body 10 due to forces applied to the retaining case 65 when the retaining case 65 is partially pulled out from the main body 10. Further, the process units 62 whose developing devices 62H and corresponding developer-accommodating devices 62G accommodating color toners can be integrally separated from the retaining case 65 as a unit are arranged toward the far side of the retaining case 65 relative to the pull-out direction. This structure of the process units 62 eliminates the opening and closing of shutters in the developer-accommodating devices 62G, thereby making replacement of the process units 62 easy and safe.

Among the developer accommodating devices 62G and the toner cartridge 100, the toner cartridge 100 can be replaced separately from the process unit 61. Since the toner cartridge 100 accommodates black toner, which is generally consumed faster than the color toners, this configuration can greatly reduce running costs.

In the process unit 61 provided with the separable toner cartridge 100, the auger 61F is provided in the developing device 200. Accordingly, the openings formed in the toner cartridge 100 and the developing device 200 (the openings 111, 112, 211, and 212 in the first embodiment) that is opened and closed by the shutters 120 and 220 in order to supply toner from the toner cartridge 100 to the supply roller 61D need not be provided across the entire longitudinal surface of the toner cartridge 100 and the developing device 200, thereby reducing the size of the openings.

Sponge-like seals for preventing toner leakage are generally provided around the edges of the openings formed in the toner cartridge 100 and the developing device 200, which openings are opened and closed by the shutters 120 and 220. The risk of toner leakage increases as the size of these openings increases. Further, increasing the region of the seals that is slidingly contacted by the shutters 120 and 220 makes the shutter operations heavier and more cumbersome. Hence, in order to improve operations of the shutters 120 and 220 and the performance of the seals, it is desirable to reduce the size of the openings formed in the toner cartridge 100 and the developing device 200 and to reduce the size of the seals required around the periphery of the openings.

Since the configuration of the first embodiment reduces the size of the openings 111, 112, 211, and 212 and the size of the seals provided around the edges of these openings, the seals can be expected to prevent toner leakage reliably over a long lifespan, and operations of the shutter 120 are accomplished easily and smoothly. Further, by reducing the size of the openings, the stiffness of the toner cartridge 100 and the developing device 200 is increased.

In the first embodiment, in addition to the supply openings 111 and 211 for receiving toner supplied from the toner cartridge 100 into the developing device 200, the return openings 112 and 212 are provided as exits for toner returning from the developing device 200 to the toner cartridge 100. Since toner is circulated between the toner cartridge 100 and the developing device 200 via these openings, the toner can be uniformly agitated and conveyed, thereby improving image quality.

The supply roller 61D is positioned closer to the near side with respect to the pull-out direction than the developing roller 61C, and the auger 61F is positioned closer to the near side with respect to the pull-out direction than the supply roller 61D. Accordingly, the toner cartridge 100 positioned above the auger 61F is also on the near side while the retaining case 65 is accommodated in the main body 10 (at the first position), whereby the toner cartridge 100 can easily be mounted, removed, or replaced.

The angle β formed by a plane passing through the rotational shaft of the developing roller 61C and the rotational shaft of the corresponding photosensitive drum 61A and a plane along the pull-out direction is smaller than the angle α formed by a plane passing through the rotational shaft of the developing roller 62C and the rotational shaft of the corresponding photosensitive drum 62A and a plane along the pull-out direction. Accordingly, the toner cartridge 100 positioned above the auger 61F is also on the near side while the retaining case 65 is accommodated in the main body 10 (at the first position), whereby the toner cartridge 100 can easily be mounted, removed, or replaced.

Since the toner cartridge 100 can be accessed from above and replaced while the retaining case 65 is accommodated in the main body 10 (first position) with this construction, the toner cartridge 100 can easily be replaced without opening the front cover 11 and removing the retaining case 65.

More specifically, the toner cartridge 100 is disposed in a position that is not overlapped vertically by the exposure unit 50, which exposes the photosensitive drums 61A and 62A from above, while the retaining case 65 is accommodated in the main body 10 (at the first position). Hence, the exposure unit 50 does not interfere with operations to access the toner cartridge 100 from above. Therefore, the toner cartridge 100 can easily be replaced, without opening the front cover 11 and pulling out the retaining case 65.

The main body 10 has the upper cover 12 positioned above the front cover 11 that can be opened and closed independently of the front cover 11. Accordingly, the toner cartridge 100 can be mounted, removed, and replaced simply by opening the upper cover 12 and without opening the front cover 11, which operation requires that sufficient space is allocated in front of the main body 10.

Figure 9:
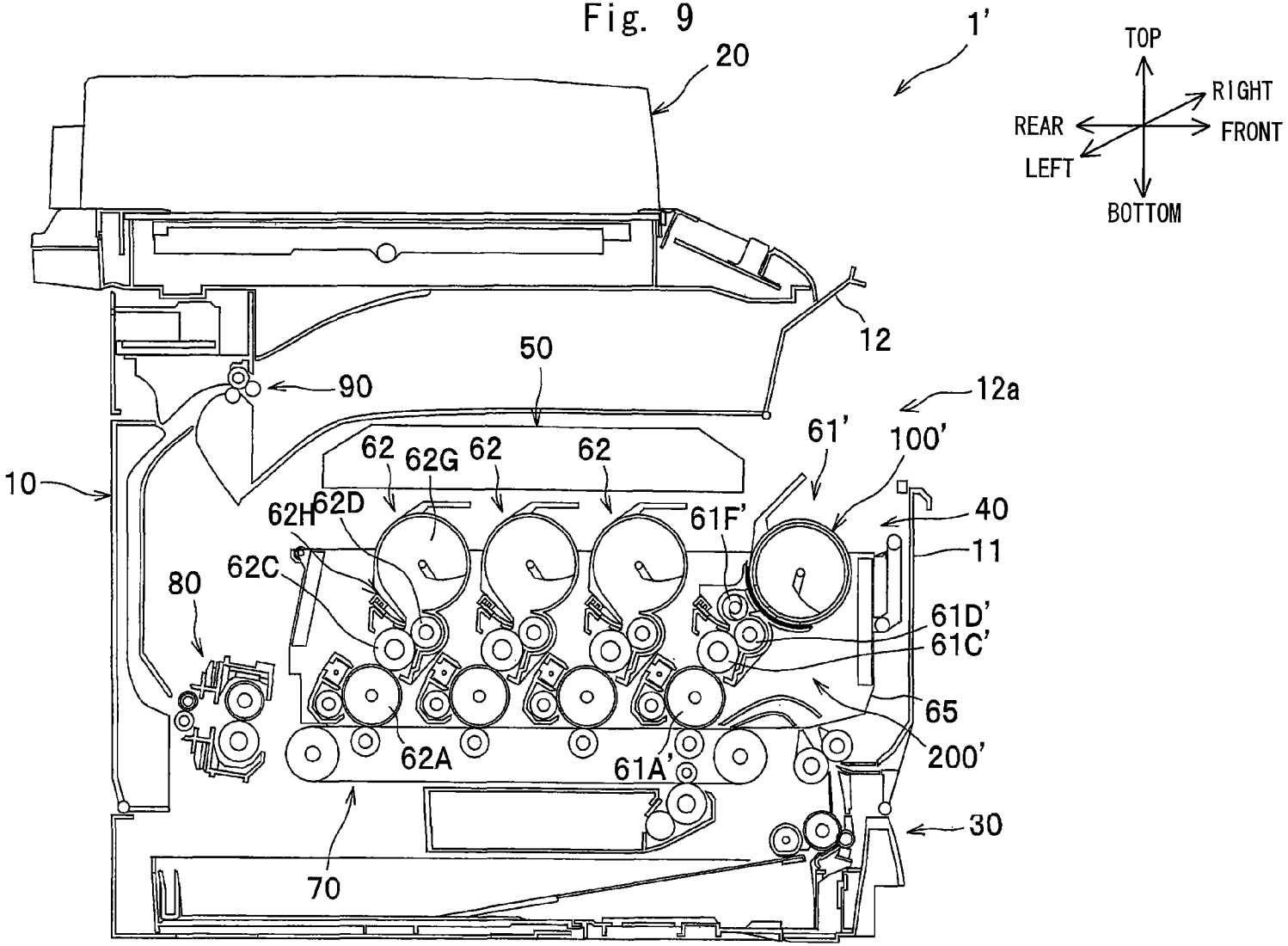
FIG. 9 is a cross-sectional view illustrating an operation in which a black toner cartridge is attached to a developing device according to a second embodiment of the present invention.

Next, a color multifunction device 1' serving as an image-forming device according to a second embodiment of the present invention will be described with reference to FIG. 9. In the color multifunction device 1' according to the second embodiment, the components of a process unit 61' are arranged differently from the process unit 61 described in the first embodiment, and these differing arrangements will be contrasted in the following description, where like parts and components are designated with the same reference numerals to avoid duplicating description.

The features of the second embodiment that differ from those in the first embodiment are found in the arrangement of the process unit 61' provided with a toner cartridge 100' accommodating black toner, and a developing device 200'. In the second embodiment, a photosensitive drum 61A', a developing roller 61C', and a supply roller 61D' have substantially the same arrangement as the photosensitive drum 62A, the developing roller 62C, and the supply roller 62D in the process units 62. Further, the supply roller 61D' is positioned forward of the developing roller 61C', as described in the first embodiment.

The size and positioning of the developing roller 61C shown in FIG. 8 are not applied to the developing roller 61C' in the second embodiment. Further, the auger 61F is disposed forward of the supply roller 61D in the first embodiment, whereas an auger 61F' is disposed above the developing roller 61C' and the supply roller 61D' in the second embodiment.

In the second embodiment, the toner cartridge 100' is positioned closer to the near side in the pull-out direction than the auger 61F' (diagonally above the auger 61F'). Accordingly, the toner cartridge 100' is disposed in substantially the same position in the main body 10 as the toner cartridge 100 of the first embodiment when the toner cartridge 100' is mounted in the accommodating recessed part 210S of the developing device 200' and the retaining case 65 is accommodated in the main body 10 (first position). Therefore, the toner cartridge 100 can easily be mounted, removed, and replaced simply by opening the upper cover 12 while the retaining case 65 remains in the first position.

When the retaining case 65 is accommodated in the main body 10, the toner cartridge 100' is disposed at a position that is not overlapped by the exposure unit 50 that exposes the photosensitive drum 61A' and the photosensitive drums 62A from above. Therefore, the exposure unit 50 does not interfere with operations to access the toner cartridge 100' from above. Thus, the toner cartridge 100' can easily be replaced without having to open the front cover 11 and pull out the retaining case 65.

While the invention has been described in detail with reference to the first and second embodiments thereof, it would be apparent to those skilled in the art that many modifications and variations may be made therein without departing from the spirit of the invention, the scope of which is defined by the attached claims.

In the first and second embodiments described above, a conveying member for conveying toner along the axial direction of the supply roller is a screw-type auger 61F (61F') having helical bits, but the present invention is not limited to this type of conveying member. Any conventional conveying means (such as means that conveys with blades) may be employed as the conveying member, provided that the member can convey toner supplied from the developer-accommodating device (toner cartridge) from the conveying start position to the conveying end position along the axis of the supply roller.

Further, the process unit 61 in the first and second embodiments has return openings 112 and 212 for recovering toner from the developing device 200 back into the toner cartridge 100 (100') and includes a mechanism for circulating this toner, but the present invention is not limited to this configuration. In a developing device having a separable toner cartridge that does not circulate toner, the size of the supply openings for supplying toner from the toner cartridge 100 into the developing device 200 can still be decreased by providing a conveying member in the developing device for conveying toner along the axis of the supply roller, thereby achieving the advantages of the present invention described above.

While the recording sheets described in the first and second embodiments are paper P, such as normal paper or postcards, the recording sheets may also be transparencies or the like.

The specific structure and arrangement of other components constituting the image-forming device, such as the exposure device, retaining member, photosensitive drums, developer-accommodating devices, and operating member (handle), may be modified as desired and are not limited to the description in the above-mentioned embodiments.

Further, while the image-forming device with process units according to the present invention is a color multifunction device 1 and 1' in the first and second embodiments, the image-forming device may also be a photocopier, printer, or the like. Also, the image-forming device of the first and second embodiments includes four process units 61 and 62, but the present invention may be applied to any image-forming device having a plurality of developer-accommodating devices, including one that accommodates black developer.

What is claimed is:

1. An image forming device comprising:

a casing formed with a first opening;

a plurality of photosensitive bodies;

a plurality of developing devices respectively corresponding to the plurality of photosensitive bodies;

a plurality of developer accommodating devices configured to accommodate and supply developer respectively to the plurality of developing devices, the plurality of developer accommodating devices including a first developer accommodating device that is individually replaceable and separable from the corresponding developing device and a second developer accommodating device that is replaceable integrally together with the corresponding developing device; and a retaining member configured to retain the plurality of photosensitive bodies arranged in an arrangement direction, the plurality of developing devices, and the plurality of developer accommodating devices at fixed positions within the casing, the retaining member configured to be pulled out from the casing in a direction extending from an upstream side of the retaining member in the arrangement direction toward a downstream side of the retaining member in the arrangement direction through the first opening and being movable between a first position where the plurality of photosensitive bodies, the plurality of developing devices, and the plurality of developer accommodating devices are inside the casing and a second position where the one of the plurality of developer accommodating devices located at the most upstream side in the arrangement direction is replaceable, wherein another one of the plurality of developer accommodating devices located at the most downstream side in the arrangement direction is the first developer accommodating device accommodating black developer, each of the developer accommodating devices other than the other one of the plurality of developer accommodating devices is the second developer accommodating device, and a length of the first developer accommodating device in the arrangement direction is greater than a length of the second developer accommodating device in the arrangement direction, wherein the plurality of developing devices includes a first developing device corresponding to the first developer accommodating device and a second developing device corresponding to the second developer accommodating device, wherein a positional relationship between the first developer accommodating device and the photosensitive body corresponding to the first developing device is different from a positional relationship between the second developer accommodating device and the photosensitive body corresponding to the second developing device, such that a position of the first developer accommodating device is shifted further downstream relative to the photosensitive body corresponding to the first developing device than a position of the second developer accommodating device relative to the photosensitive body corresponding to the second developing device, wherein the first developing device and the second developing device respectively include a developing roller and a supply roller, and the plurality of photosensitive bodies include a first photosensitive body, which is the photosensitive body corresponding to the first developing device, and a second photosensitive body, which is the photosensitive body corresponding to the second developing device, and wherein a first acute angle formed by a plane passing through a rotational axis of the developing roller of the first developing device and a rotational axis of the first photosensitive body and a plane parallel to the arrangement direction passing through the rotational axis of the first photosensitive body is smaller than a second acute angle formed by a plane passing through a rotational axis of the developing roller of the second developing device and a rotational axis of the second photosensitive body and a plane parallel to the arrangement direction passing through the rotational axis of the second photosensitive body.

2. The image forming device according to claim 1, wherein the first developing device is formed with a supply opening for receiving the developer from the first developer accommodating device, and includes a developing roller, a supply roller, a shutter that selectively opens and closes the supply opening and a conveying member that has a conveying start region in confrontation with the supply opening and that conveys the developer from the conveying start region along an axial direction of the supply roller of the first developing device.

3. The image forming device according to claim 2, wherein the first developing device is further formed with a return opening as an exit for the developer returning from the first developing device to the first developer accommodating device, and the conveying member has a conveying end region in confrontation with the return opening and conveys the developer from the conveying start region toward the conveying end region.

4. The image forming device according to claim 2, wherein the supply roller of the first developing device is disposed downstream of the developing roller of the first developing device in the arrangement direction, and the conveying member is disposed downstream of the developing roller of the first developing device in the arrangement direction.

5. The image forming device according to claim 4, wherein the first developer accommodating device is disposed above the conveying member.

6. The image forming device according to claim 1, wherein the first developing device and the second developing device respectively include a developing roller and a supply roller, and wherein the developing roller of the first developing device has a diameter that is greater than a diameter of the developing roller of the second developing device.

7. The image forming device according to claim 1, wherein the first developer accommodating device is replaceable from above when the retaining member is at the first position.

8. The image forming device according to claim 7, further comprising an exposure device for exposing the plurality of photosensitive bodies from above, wherein the exposure device is provided in the casing such that the exposure device does not overlap with the first developer accommodating device in a vertical direction when the retaining member is at the first position.

9. The image forming device according to claim 7, wherein the casing includes a cover for selectively opening and closing a second opening formed in the casing independently of opening and closing of the first opening, and wherein the first developer accommodating device is replaceable through the second opening when the retaining member is at the first position.

10. The image forming device according to claim 7, wherein the first developer accommodating device is formed with a supply opening for supplying developer to the corresponding developing device, and the first developer accommodating device includes a shutter that selectively opens and closes the supply opening.

11. The image forming device according to claim 10, wherein the first developer accommodating device includes an operation unit configured to selectively switch the shutter between an open position at which the supply opening is open and a closed position at which the supply opening is closed, and the operation of the operation unit is in association with the engagement and disengagement between the first developer accommodating device and the corresponding developing device, wherein, when the retaining member is at the first position, the operation unit is operable from above, wherein the first developer accommodating device engages with the developing device when the shutter is switched to the open position, and the first developer accommodating device disengages from the developing device when the shutter is switched to the closed position.

12. The image forming device according to claim 1, wherein the developer accommodated in the first developer accommodating device is a pulverized toner, and the developer accommodated in the second developer accommodating device is a chemical toner.

13. The image forming device according to claim 12, wherein the pulverized toner accommodated in the first developer accommodating device is non-magnetic, and the chemical toner accommodated in the second developer accommodating device is non-magnetic.

* * * * *